US006840856B2

(12) United States Patent
Stern

(10) Patent No.: US 6,840,856 B2
(45) Date of Patent: Jan. 11, 2005

(54) APPARATUS FOR AND METHOD OF VIDEO GAMING

(76) Inventor: Max Stern, 6351 Chisos Dr., Las Vegas, NV (US) 89103

( * ) Notice: Subject to any disclaimer, the term of this patent is extended or adjusted under 35 U.S.C. 154(b) by 5 days.

(21) Appl. No.: 09/981,467

(22) Filed: Oct. 17, 2001

(65) Prior Publication Data

US 2002/0068620 A1 Jun. 6, 2002

Related U.S. Application Data

(60) Provisional application No. 60/241,019, filed on Oct. 17, 2000.

(51) Int. Cl.[7] ..... A63F 9/24
(52) U.S. Cl. ..... 463/16
(58) Field of Search ..... 463/11–13, 16–22, 463/40–42, 25, 29; 273/274, 309, 292, 138.1, 138.2, 139, 236–237, 293, 269, 303

(56) References Cited

U.S. PATENT DOCUMENTS

| | | | | | |
|---|---|---|---|---|---|
| 5,042,818 | A | * | 8/1991 | Weingardt | 463/13 |
| 5,624,119 | A | * | 4/1997 | Leake | 463/19 |
| 5,816,915 | A | * | 10/1998 | Kadlic | 463/13 |
| 5,976,016 | A | * | 11/1999 | Moody et al. | 463/13 |
| 6,098,985 | A | * | 8/2000 | Moody | 463/13 |

* cited by examiner

*Primary Examiner*—Mark Sager
(74) *Attorney, Agent, or Firm*—Jeffrey C. Maynard

(57) ABSTRACT

A method and apparatus for playing a game of skill and chance for one or more players, in which colored, numbered balls comprise the contest elements. Players can bet on obtaining predetermined combination of elements. Players are permitted to reject some or all elements and receive substitute elements to complete a final combination of elements. The final combination is evaluated against a predetermined pay table of values to determine the pay out, if any, to the player. Apparatus may include electronic or mechanical game machines.

10 Claims, 5 Drawing Sheets

APPARATUS FOR AND METHOD OF VIDEO GAMING

This Application claims the benefit of U.S. Provisional Application Ser. No. 60/241,019 entitled Apparatus for and Method of Video Gaming, filed with the U.S. Patent and Trademark Office on Oct. 17, 2000.

BACKGROUND OF THE INVENTION

1. Field of the Invention

The present invention relates to new games of chance and intellectual skill, in particular for video gambling machines, computer games, or other electronic or mechanical devices, in which a player uses random chance contest elements, such as numbered balls, to obtain combinations of elements according to a scale of values for such combinations. In its more particular embodiments, the present teachings specifically pertain to a game of chance and skill in which a participant attempts to achieve a particular winning combination of subsets of the chance elements, relying on observations, luck, and skill in his or her selection for each individual game.

2. Background of the Prior Art

In previous games involving chance played in casinos and elsewhere, which utilize random chance devices, such as craps, roulette, and the like, a participant bets on predicting the outcome of a random event. Wagering can be extremely complicated due to the large number of possible discrete random events.

In games that utilize playing cards, such as poker, blackjack, gin rummy-type games, and the like, a player competes against other players in the game and sometimes against a dealer, who usually represents the playing establishment or "house." Those games generally include wagering, involving either other players or the house; the competition is against one or more other players and, ultimately, against the house.

In such previous games, players who have acquired superior skill and experience have an advantage and can more readily take advantage of less experienced players. Similarly, aggressive players with little concern for loss of large amounts of money can drive timid, less fortunate players out of the game by quantitatively increasing wagers beyond the tolerance of other players.

Single player electronic video games have been developed to avoid player-to-player competition and permit players of all skill levels to enjoy the same types of games while affording an opportunity to wager.

For example, electronic video poker games have been prevalent in gaming casinos for many years. The electronic video poker gaming machine is designed to replicate the play of a hand of poker. Typically, a player is not playing against any other players or against a dealer's hand; the player is simply attempting to achieve the highest-ranking poker hand possible from the cards displayed to the player.

Video poker is generally played on an electronic video gaming machine that uses a video screen display to show cards to a player. Computer controls carried on a printed circuit board mounted on the interior of the gaming machine electronically shuffle the deck of cards, activate the dealing sequence in response to input by a player, cause the cards to be displayed on the video screen display, and analyze the hand to determine winning and losing hands. The computer controls also affect payouts to the player based on the amount of the player's wager and the poker ranking of the hand.

The higher the poker hand achieved by the player, the greater the player's winnings based on the number of coins, tokens or credits wagered by the player. Typically, a payout schedule is posted on the gaming machine to advise the player of the payoffs available for certain winning card combinations.

Players have become bored with traditional video poker. Players prefer to play those machines that have pay tables with higher payouts for the types of winning combinations that are achievable. There is a need for new video gaming machines that are capable of encouraging a high volume of play while at the same time offering what the players consider to be good pay tables.

Gaming casino operators are desirous of having different types of electronic video games to offer to players. There is a need to provide new and interesting electronic video games that attract players and that can increase the volume of wagering in each gaming machine.

SUMMARY OF THE INVENTION

An object of the present invention is straightforward entertainment with some of the skill, guess and atmosphere of a casino.

Another object is to enable a participant to choose from a variety of possible combinations of chance elements to play a game of skill and chance.

Another object is to enable implementation of a novel game of skill and chance by a gaming establishment, such as a casino, which supervises and controls the flow of the game for a predetermined, but non-participatory, fee.

A further object is to enable adaptation of the invention to usage independent of a gaming establishment, including individual personal usage.

Another object is to promptly provide visible winning results, solely for entertainment purposes, or additionally for wagering, such that a casino atmosphere of chance is available for a single, or for a plurality of participants.

Another object is to enable a participant, or plural participants, to play more than one hand in a single round of the game being played.

Another object is implementation of supervision and control of the flow of a game by software, or by gaming establishment personnel.

It is an object of the present invention to provide a completely new and interesting game of skill and chance, which will attract players by offering the player a good pay table.

It is a further object of the invention to provide methodology for playing new and interesting games of chance and skill wherein the games encourage a high amount of individual player interest while maintaining acceptable payback percentages.

It is yet another object of the invention to provide a video gaming machine apparatus, which displays a new and interesting game of chance and skill that encourages a high amount of individual player interest while maintaining acceptable payback percentages.

The goal of the game is to play skillfully with the random chance elements of the game by taking advantage of an opportunity to hold some, or all elements, or exchange for additional chance elements. A player can achieve a winning combination of elements according to a defined table of values. If the final combination of elements contains a winning combination, the player receives payment on his wager according to the pay table. If the final combination of elements does not contain any winning combination according to the table of values, that player loses his wager.

Whether solely for amusement or for entertainment with wagering, an electronic video game machine can be used. Random chance elements can be displayed in an electronic or other machine play apparatus.

Among the advantages of the invention are the simplicity of play and ease of administration. This invention provides a novel game that is easy to administer and fun to play.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following detailed description, which should be read in conjunction with the accompanying drawings in which like reference numbers are used for like parts. This detailed description of an embodiment, set out below to enable one to build and use an implementation of the invention, is not intended to limit the enumerated claims, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

Play of the novel game disclosed herein involves a predetermined plural number of sets of contest elements. For example, ten numbered balls constitute one set of chance elements; five such sets provide a total of fifty (50) chance elements, representing one unit. Each set should be a different color; for example, a first set may comprise ten (10) black elements numbered zero (0) to nine (9), a second set may comprise ten (10) red elements numbered zero (0) to nine (9), a third set may comprise ten (10) green elements numbered zero (0) to nine (9), a fourth set may comprise ten (10) yellow elements numbered zero (0) to nine (9), and a fifth set may comprise ten (10) blue elements numbered zero (0) to nine (9). One unit comprises five sets of different colors. Although the games are designed to be played with five sets of chance elements (one unit), the games can be played by using as many units, complete or incomplete, as desired. The game can be played with colored balls, or whatsoever kind of objects containing elements that can be subdivided into the same distribution as described; that is, five groups of ten numbered elements, each group of elements of differing colors, forms, or objects.

Figure 1:
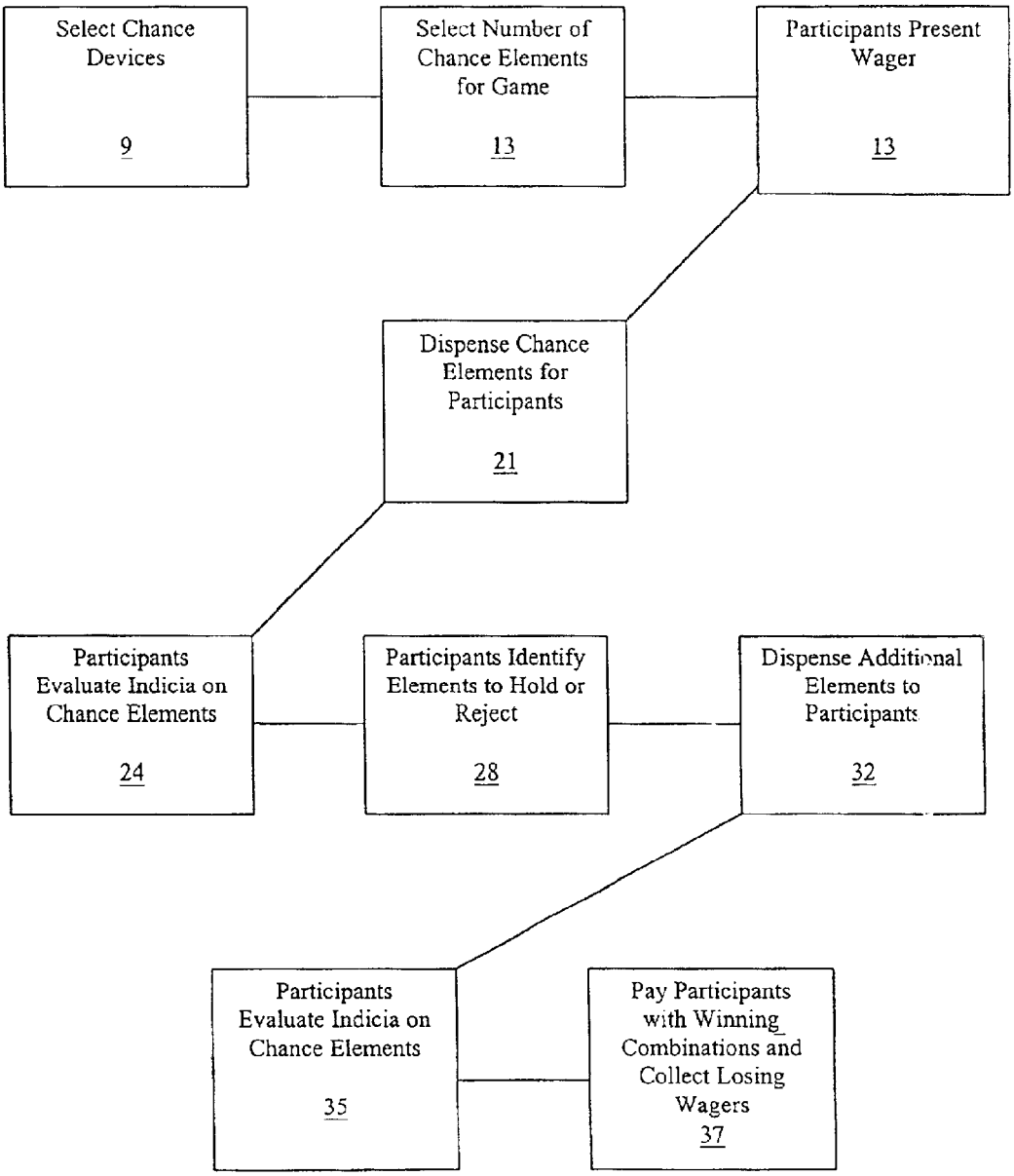
FIG. 1 is a flow chart illustrating steps of a specific embodiment of the invention.

Referring to a specific embodiment, further shown and described in more detail in relation to the drawings, FIG. 1 represents the sequence of steps establishing and carrying out a specific embodiment of the method of the invention.

Station 9 indicates selection of chance elements for a game. The chosen game is played on a machine, in a casino, in a club or in a home.

In the second step, at station 13, the number of chance elements for a game is selected. In a preferred embodiment, a game is played using five chance elements in an initial 'hand'. Alternate embodiments can be played using three, four or more elements.

In the third step, depicted at station 16, if not earlier, a player presents a wager, signifying an ante or cost to participate. For play of the game, each player selects a quantitatively fixed wager for every game. The amount of the wager may not be increased or decreased during the later-described stages of the invention, as the game is being played. The host establishment can prescribe a minimum and maximum wager for each individual game. (The apparatus for home game play enables selective determination if wagering is to be involved.) Such a quantitatively fixed wager is made for each hand, if that participant selects to play more than one 'hand'. A minimum and maximum for competitive wagering can be prescribed for an individual round. Present concepts can provide for handling differing wagering amounts for one or more participants. In a specific embodiment, the host establishment can require an entry fee for participation in the game as well as a wager for each game. Personal wagering is estimated based on factors including experience in obtaining one or more 'hands' with a winning combination of elements in the type of game to be played, after elements have been dispensed. Payout for winning combinations may be dependent upon the amount of the wager.

In the fourth step, at station 21, the preselected number of chance elements is displayed for the player. In one embodiment, five of the fifty elements are dispensed for such player.

In the fifth step, at station 24, the player evaluates the combination of elements dispensed for that player against a selected table of values for each combination of elements in the game.

In the sixth step, represented by reference number 28, the player can reject from zero to all of the original elements received; or, such player can keep all the elements or change some, or all, of the elements. A player decides which, if any, elements should be kept or rejected depending on his or her skill and expertise.

In the seventh step, indicated by station 32, additional chance elements are selectively distributed from the remaining elements in the initial unit to the player, in accordance with the number of elements, if any, rejected by the player in the sixth step (station 28).

In the eighth step, at station 35, the combination of elements 'held' by the player is evaluated against a predetermined pay table. A ranking for each 'hand' displayed is evaluated according to conventional ranking as shown in TABLE I. With completion of respective changes, the round is complete and the player wins or loses more or less than that player's original wager, according to the game played.

In the ninth step, indicated by station 37, each player with a winning combination of elements, is paid according to the rank for each such winning 'hand'. A player with a winning combination of elements is paid on his wager, according to the scale of values and pay table of the game.

Alternate embodiments of the game disclosed herein can be played at a gaming table with a plurality of players in which the player with the highest combination of elements wins a 'pot' established by the addition of each player's wager.

In a preferred embodiment, the game is controlled by an electronic video game machine that does not compete against the player. In an alternate embodiment, the game can be played at a table utilizing physical balls with such version of the game controlled by a dealer. The steps and functions of a controller are established by software and take place electronically in video games to provide and distribute electronic designations of game elements, to maintain control of play of the game for plural players, and to sequence the steps of the game properly, while providing for selections made by a player, or players. Such game controller is also responsible for collecting wagers that are lost and making payments to winners, according to the selected pay table. The electronic video game machine provides functions to randomize the chance elements, to distribute the elements to a player, or players, and to keep control and order to the steps of the game. The electronic video game machine automatically collects the wagers from the losers and makes payments to the winners.

An electronic video gaming machine upon which the method of the present invention can be practiced is well known in the art. The gaming machine includes a video display screen, a coin slot into which players may introduce coins or tokens and may also include a bill acceptor into which players may introduce paper currency, all of which are conventional in electronic video gaming machines.

As is also conventional, buttons are provided by which a player operates the gaming machine to cause elements to be displayed, held and rejected. A cash out button is also provided to cause any credits accrued to be cashed out by the player. Instead of using buttons to operate the gaming machine, conventional touch screen technology can also be used. Any suitable electronic video gaming machine can be modified so that the method of the present invention can be practiced thereon.

Fundamental concepts of the invention are explained in relation to a preferred embodiment based on use of five sets of contest elements; that is, one unit, for example, ten (10) black elements numbered zero (0) to nine (9), ten (10) red elements numbered zero (0) to nine (9), ten (10) green elements numbered zero (0) to nine (9), ten (10) yellow elements numbered zero (0) to nine (9), and ten (10) blue elements numbered zero (0) to nine (9) are used.

Figure 2:
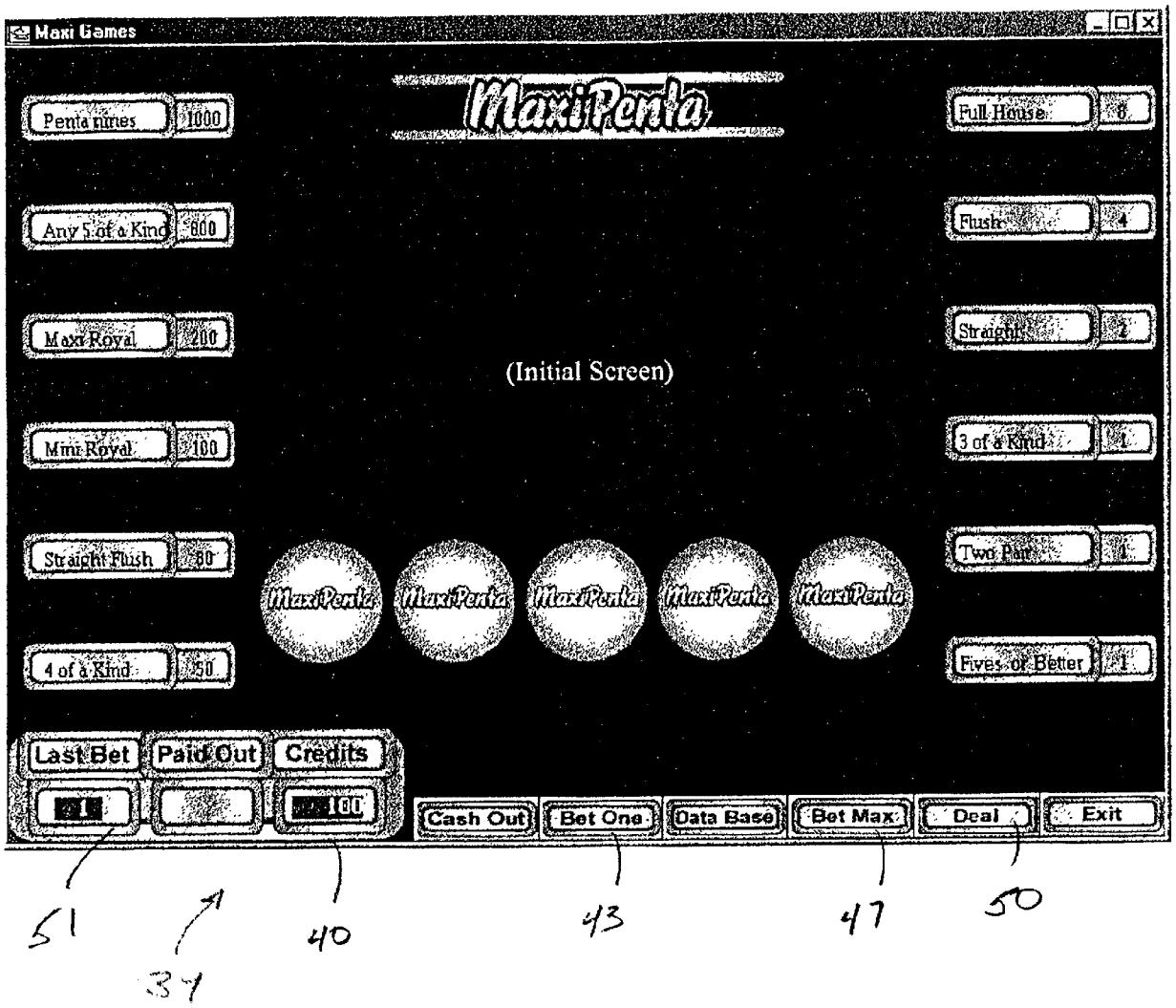
FIG. 2 shows a front elevational view of an electronic video gaming machine display for describing specific steps of one embodiment of the present invention.

Referring now to FIG. 2, there is presented an initial video screen display 39 for an exemplary embodiment of the present invention. The player introduces coins or gaming tokens into a coin slot or paper currency into a bill acceptor to activate the gaming machine. Any coins, tokens, or value from paper currency introduced into the electronic video game machine is indicated as credits on the credit meter 40. The player indicates the desired number of coins, tokens or credits to wager using button 43. The player can wager the entire amount of available credits by using button 47. To begin play of a game, the player activates the gaming machine by pressing a "Deal" button 50 on the screen to cause the initial deal of elements to be displayed on the video screen. Any coins, tokens, or value from paper currency introduced in excess of the amount the player wishes to wager are accrued as credits on the credit meter 40. The amount of the last wager is also displayed at 51.

The display screen 39 is sized to display five playing elements as well as a credit meter display 40 and indications of values for winning combinations of elements, such as shown in TABLE I. In a preferred embodiment of the present invention, five elements from a single unit of fifty elements are displayed on the video screen 39. In an alternate embodiment, additional complete or incomplete units may be used.

Figure 3:
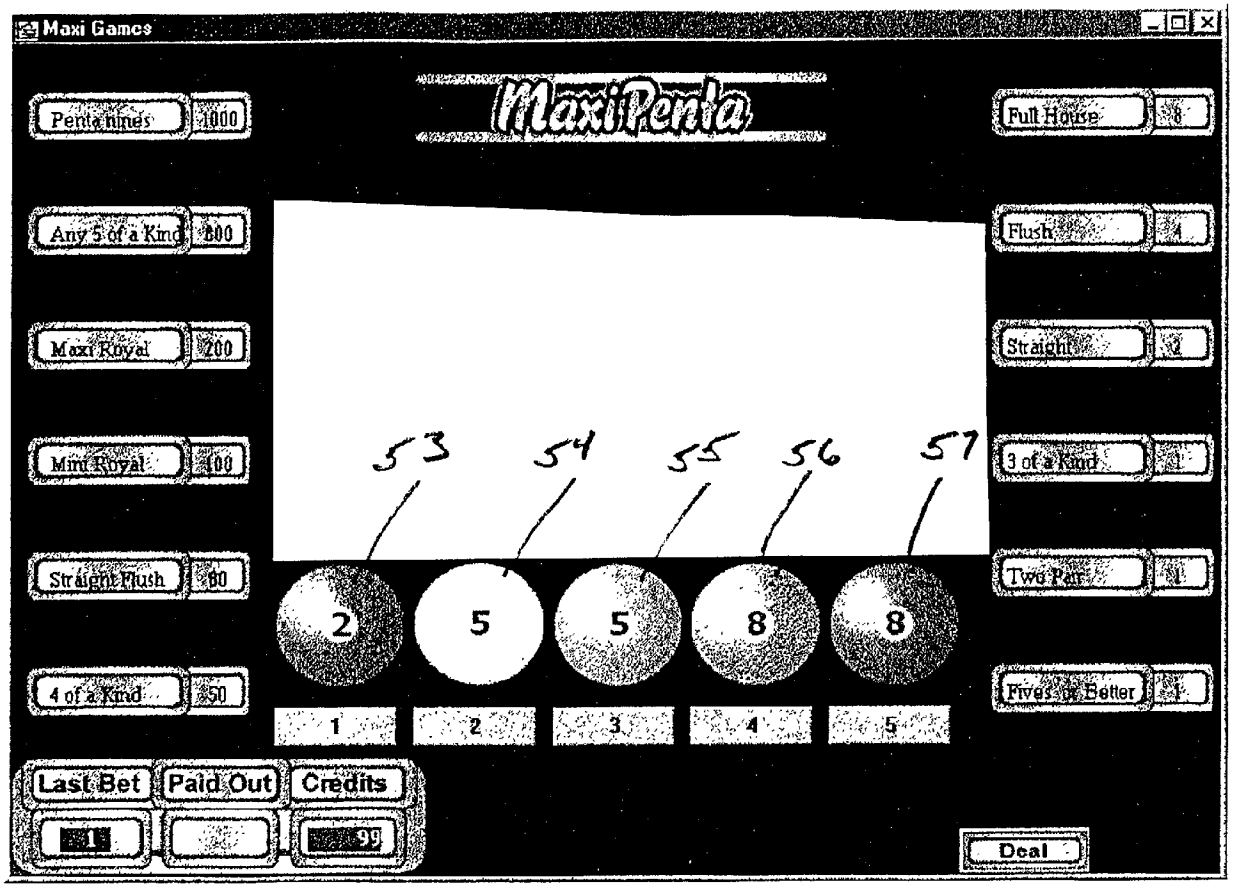
FIG. 3 shows a front elevational view of an electronic video gaming machine display for describing additional steps of one embodiment of the present invention.

In the example shown in FIG. 3, the player is dealt a blue 2 (53), a yellow 5 (54), a green 5 (55), a red 8 (56), and a blue 8 (57). The player then selects which of these initial five elements the player wishes to hold by pressing the video screen 39 at the location of the elements the player wishes to hold.

In this example, the player would most likely hold the yellow 5 (54), green 5 (55), red 8 (56), and blue 8 (57). The blue 2 (53) would be rejected and a replacement element from the original remaining unit of elements would be displayed on the video screen 39.

Figure 4:
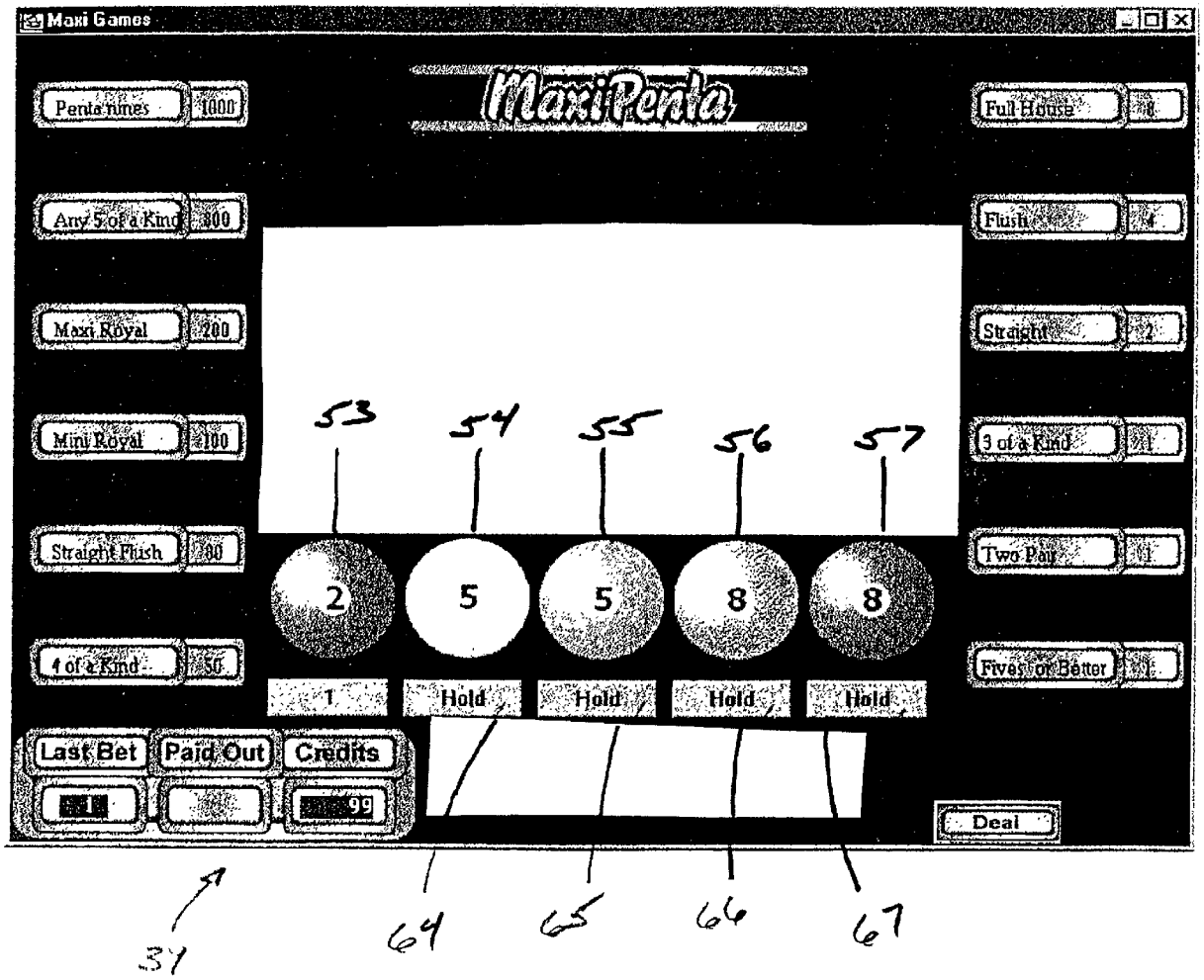
FIG. 4 shows a front elevational view of an electronic video gaming machine display for describing additional steps of one embodiment of the present invention.

FIG. 4 shows an example of the video screen display 39 after the player has selected which elements to hold from the initial display, as indicated by hold buttons 64, 65, 66, 67.

Figure 5:
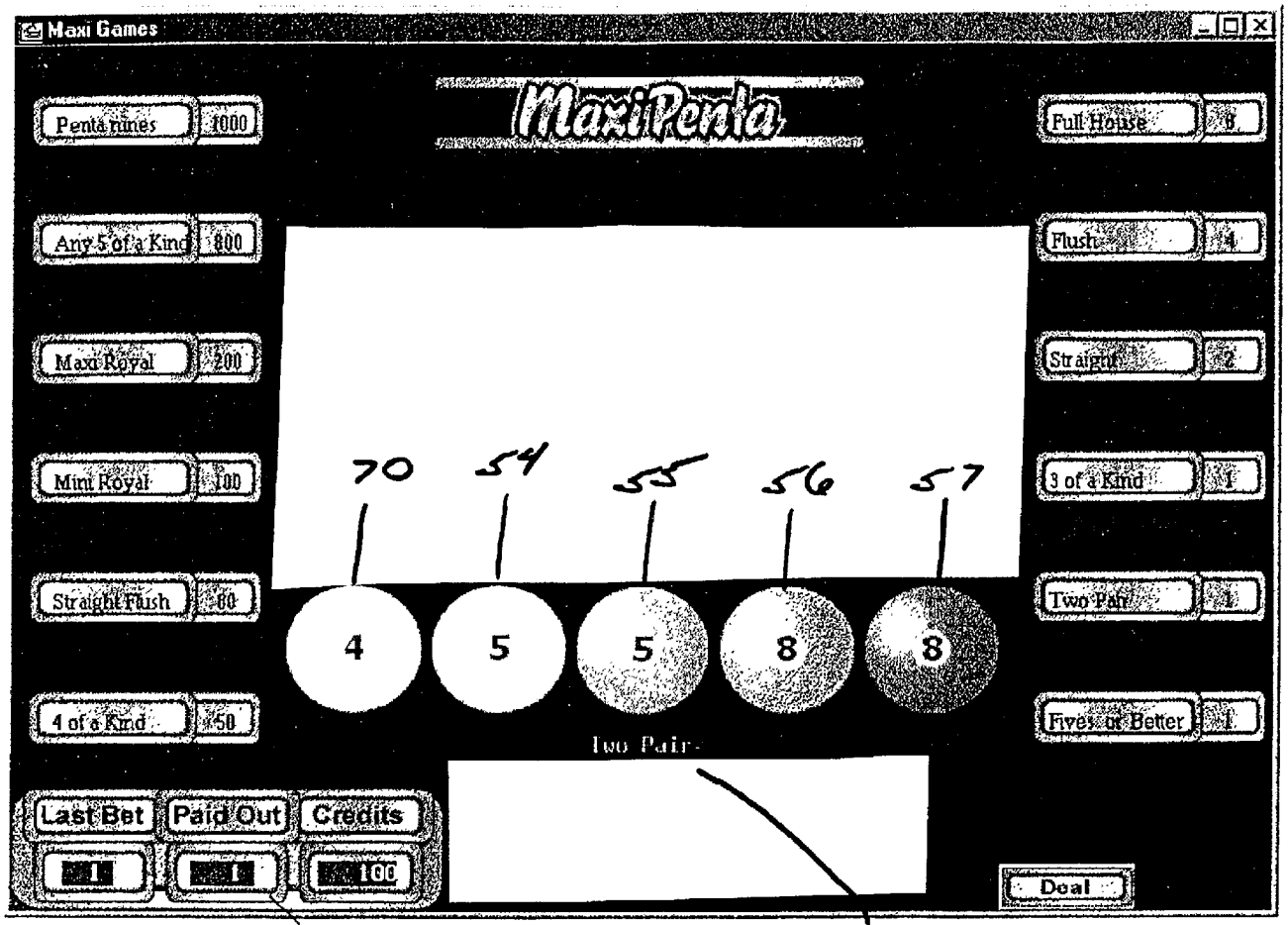
FIG. 5 shows a front elevational view of an electronic video gaming machine display for describing additional steps of one embodiment of the present invention.

In the example, FIG. 5, the player receives a yellow 4 (70) as the replacement element to combine with the yellow 5 (54), green 5 (55), red 8 (56), and blue 8 (57).

In the final combination, the player has achieved two pair, as indicated at 71. Since two pair represents a winning combination, the player receives a pay out 74 according to a predetermined payout table of values, such as TABLE I. Such pay table reflects the probabilities of obtaining particular combinations of elements.

The amount that the player wins is displayed on screen 39 at reference number 74 and is based on the ranking of the 'hand' achieved by the player and the amount wagered by the player. If a player's final 'hand' contains a winning combination of elements, the player receives payment on his or her wager. If a player's final 'hand' does not contain a winning combination of elements, that player loses his or her wager.

As can be seen from the description of the embodiments, the present invention can be played using physical balls or cards with representations of balls thereon, and is readily adaptable to play on a computer or video game. A person skilled in the art of computer and video game construction, as well as those skilled in other arts, will incorporate the method and conduct of this invention in such computer and video games.

A preferred embodiment of the invention comprises a video game of chance and skill, for an individual player, wherein the apparatus methodology comprises the steps of:

a) machine acceptance from the game player of an initial "bet" wager via a coin or token entry slot of the machine or from the player's machine credit bank;

b) machine random dealing and video display of five chance elements to the player from the electronic bank of 50 multicolored random chance elements;

c) permitting the player, after viewing his or her displayed 'hand', via appropriate machine control buttons, to either: stand on the 'hand' as dealt, or reject one or more of the original chance elements with replacement of such rejected elements with machine dealt elements;

d) machine random dealing from the remainder of the bank and video display of replacement elements in a player's final 'hand'; and e) machine evaluation of the player's final 'band' with respect to the pay table of winning hands for the disclosed video game of the machine and pay-off to the player's machine credit bank of an appropriate amount of coins or tokens for a winning 'hand' according to the pay table of winning hands as related to the number of coins or tokens wagered.

The game is preferably played in video game machines, mechanical game machines, computers, and hand-held, mechanical or video game devices. An electronic video game machine can enable a single player to play more than one 'hand' at a time and can be used to accommodate plural players.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein. Therefore, for purposes of determining the scope of patent protection, reference shall be made to the appended claims in combination with the above detailed description.

TABLE I

| Relative Ranking of Winning Combinations and Prizes | |
|---|---|
| Five Nines (one 9 of each color) | 1000 |
| Five of a Kind (any 5 elements of same value) | 800 |
| Maxi-Royal (9, 8, 7, 6, 5 of same color) | 200 |
| Mini-Royal (0, 1, 2, 3, 4 of same color) | 100 |
| Straight Flush (any 5 sequential elements of same color) | 80 |
| Four of a Kind (any 4 elements of same value) | 50 |
| Full House (any 3 elements of same value and 2 other elements of same value) | 8 |
| Flush (any 5 elements of same color) | 4 |
| Straight (any 5 sequential elements of different color) | 2 |
| Three of a Kind (any 3 elements of same value) | 1 |
| Two Pair (any 2 elements of same value and 2 other elements of same value) | 1 |
| One Pair: Fives or better (any 2 of 5, 6, 7, 8, 9) | 1 |

What is claimed is:

1. Method for conducting a game for one or more players, comprising (A) providing plural sets of contest elements for such game in which the contest elements include:

(i) a surface area with playing indicia, and in which (ii) each such set includes a plurality of identical subgroups of contest elements of:

(a) selected coloring, and (b) selected repetitive playing indicia on such surface area;

(B) providing a game controller to distribute contest elements to each player in the game;

(C) establishing a table of values for winning combinations of contest elements, (i) such table of values including at least one combination consisting of a sequential series of indicia in which the last element of such series corresponds to the highest order of such indicia, with all elements of the same color, and;

(ii) such table of values including at least one combination consisting of a sequential series of indicia in which the first element of such series corresponds to the lowest order of such indicia, with all elements of the same color; wherein (iii) such winning combination according to (i) and (ii) is a higher ranking combination than a combination consisting of a sequential series of indicia in which the first element of such series does not correspond to the lowest order of such indicia or the last element of such series does not corresponds to the highest order of such indicia, with all elements of the same color;

(D) distributing, by means of such controller, a selected number of contest elements to each player, with each player receiving the same number of contest elements;

(E) enabling each player to evaluate the combination of such received contest elements based on such table of values to elect whether or not to reject one or more contest elements;

(F) permitting each player to selectively reject, for return to such controller, from zero to all contest elements obtained in Step (D);

(G) distributing additional contest elements, by such controller, to each player corresponding to the number of contest elements, if any, rejected in Step (F); and (H) evaluating the combination of contest elements held by each player against such table of values.

2. The method of claim 1, in which the number of sets of contest elements is at least five.

3. The method of claim 1, in which the contest elements comprise, colored balls.

4. The method of claim 1, in which such repetitive playing indicia comprise representations of numerals 0, 1, 2, 3, 4, 5, 6, 7, 8, 9.

5. The method of claim 1, in which the number of contest elements distributed to each player, is selected from the group consisting of three, four and five.

6. The method of claim 1, further comprising the steps of:

(I) permitting each player to place a wager at the beginning of the game; and (J) paying, by such controller, each player having a winning combination of contest elements, as determined by the table of values according to the player's wager.

7. The method of claim 1, in which such game controller is selected from the group consisting of:

a) electronic video game machines;

b) mechanical game machines;

c) computers;

d) hand-held mechanical devices; and e) hand-held video devices.

8. The method of claim 6, in which such game controller is selected from the group consisting of:

a) electronic video game machines;

b) mechanical game machines;

c) computers;

d) hand-held mechanical devices; and e) hand-held video devices.

9. Method for conducting a wagering game for one or more players, comprising (A) providing five sets of balls for such game in which, each such set includes ten balls:

(i) of unique coloring, selected from the group consisting of (a) black;

(b) red;

(c) yellow;

(d) blue; and (e) green;

(ii) having selected repetitive playing indicia on their surface area comprising representations of numerals 0, 1, 2, 3, 4, 5, 6, 7, 8, 9;

(B) providing a game controller;

(C) establishing a table of values for combinations of balls, (i) such table of values including at least one combination consisting of a sequential series of indicia in which the last element of such series corresponds to the highest order of such indicia, with all balls of the same color, and;

(ii) such table of values including at least one combination consisting of a sequential series of indicia in which the first element of such series corresponds to the lowest order of such indicia, with all balls of the same color; wherein (iii) such winning combination according to (i) and (ii) is a higher ranking combination than a combination consisting of a sequential series of indicia in which the first element of such series does not correspond to the lowest order of such indicia or the last element of such series does not corresponds to the highest order of such indicia, with all elements of the same color;

(D) permitting each player to place a wager at the beginning of the game;

(E) distributing, by means of such controller, three balls to each player;

(F) enabling each player to evaluate the combination of such received balls based on such table of values to elect whether or not to reject one or more balls;

(G) permitting each player to selectively reject, for return to such controller, from zero to all balls obtained in Step (E);

(H) distributing additional balls, by such controller, to each player corresponding to the number of balls, if any, rejected in Step (G);

(I) evaluating the combination of balls held by each player against such table of values; and (J) paying, by such controller, each player having a winning combination of balls, as determined by the table of values according to the player's wager.

10. The method of claim 9, in which such game controller is selected from the group consisting of:

a) electronic video game machines;

b) mechanical game machines;

c) computers;

d) hand-held mechanical devices; and e) hand-held video devices.

* * * * *